US005301655A

United States Patent [19]

Licata

[11] Patent Number: 5,301,655

[45] Date of Patent: Apr. 12, 1994

[54] FIREPLACE DRAFT ELIMINATOR

[76] Inventor: Anthony E. Licata, P.O. Box 177, Blakeslee, Pa. 18610-0177

[21] Appl. No.: 65,490

[22] Filed: May 24, 1993

[51] Int. Cl.[5] ..... F24B 1/192

[52] U.S. Cl. ..... 126/547; 49/466

[58] Field of Search ..... 126/547, 319; 49/463, 49/466

[56] References Cited

U.S. PATENT DOCUMENTS

| | | | |
|---|---|---|---|
| 3,797,172 | 3/1974 | Cannon | 49/463 |
| 3,888,232 | 6/1975 | Le Brun | 126/547 |
| 4,160,442 | 7/1979 | Fox et al. | 126/547 |

*Primary Examiner*—Carroll B. Dority
*Attorney, Agent, or Firm*—Richard L. Miller

[57] ABSTRACT

A fireplace draft eliminator is provided for a fireplace having an opening in a front face about a hearth, and consists of a rear plate being of the same size and shape as the opening, so as to fit into the opening. An internal support frame is slightly smaller in size and shape as the rear plate and is attached to a front surface of the rear plate. A resilient gasket is mounted on the periphery of the internal support frame. The internal support frame and the gasket together are of the same size and shape as the rear plate, so as to also fit into the opening, with the gasket forming a seal about the opening and the hearth. A front plate is of generally the same shape as, but of greater marginal extent in height and width than the opening. The front plate is attached to a front surface of the internal support frame, so that the front plate can cover the opening and rest flat against the front face of the fireplace to eliminate the draft through the opening, when the fireplace is not being used. When the draft eliminator 10 is fabricated out of all fireproof materials it can also be used to choke out a fire in a fireplace when unusual down draft conditions cause smoke and gases to be undesirably forced back into a dwelling.

4 Claims, 1 Drawing Sheet

FIREPLACE DRAFT ELIMINATOR

BACKGROUND OF THE INVENTION

The instant invention relates generally to fireplace accessories and more specifically it relates to a fireplace draft eliminator.

Numerous fireplace accessories have been provided in the prior art that are adapted to be ornamental covers for hiding openings of fireplaces when the fireplaces are not in use. For example, U.S. Pat. Nos. 3,736,024 to Wooland; 3,894,527 to Ickes and 4,160,442 to Fox et al. all are illustrative of such prior art. While these units may be suitable for the particular purpose to which they address, they would not be as suitable for the purpose of the present invention as hereafter described.

SUMMARY OF THE INVENTION

A primary object of the present invention is to provide a fireplace draft eliminator that will overcome the shortcomings of the prior art devices.

Another object is to provide a fireplace draft eliminator which when properly inserted into a fireplace opening will eliminate almost all air drafts from a chimney and heat loss from a room.

An additional object is to provide a fireplace draft eliminator that can be quickly removed and replaced whenever desired by a person without the use of special tools or skills.

A further object is to provide a fireplace draft eliminator that is simple and easy to use.

A still further object is to provide a fireplace draft eliminator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
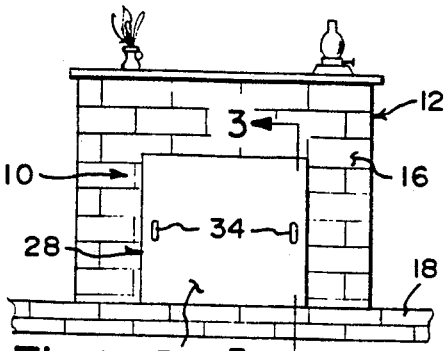
FIG. 1 is a diagrammatic front elevational view of a fireplace with the instant invention installed therein.
Figure 3:
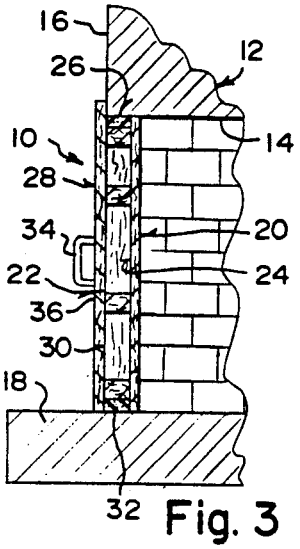
FIG. 3 is a cross sectional view taken on line 3—3 of FIG. 1.

Turning now descriptively to the drawings, in which similar reference characters denote similar elements throughout the several views, FIGS. 1 through 5 illustrate a fireplace draft eliminator 10 for a fireplace 12, having an opening 14 in a front face 16 above a hearth 18. The invention consists of a rear plate 20 being of the same size and shape as the opening, so as to fit into the opening 14. An internal support frame 22 is slightly smaller in size and shape as the rear plate 20 and is attached to a front surface 24 of the rear plate 20. A resilient gasket 26 is mounted on the periphery of the internal support frame 22. The internal support frame 22 and the gasket 36 together are of the same size and shape as the rear plate 20, so as to also fit into the opening 14, with the gasket 26 forming a seal about the opening 14 and the hearth 18. A front plate 28 is of generally the same shape as, but of greater marginal extent in height and width than the opening 14. The front plate 28 is attached to a front surface 30 of the internal support frame 22, so that the front plate 28 can cover the opening 14 and rest flat against the front face 16 of the fireplace, to eliminate the draft through the opening 14 when the fireplace 12 is not being used.

Figure 4:
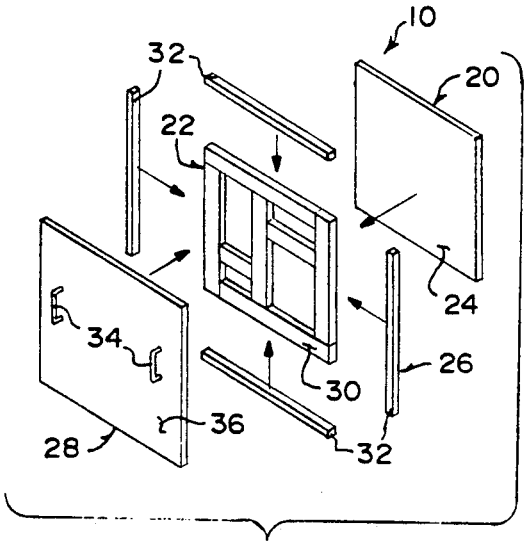
FIG. 4 is a diagrammatic exploded perspective view of the instant invention per se.
Figure 2:
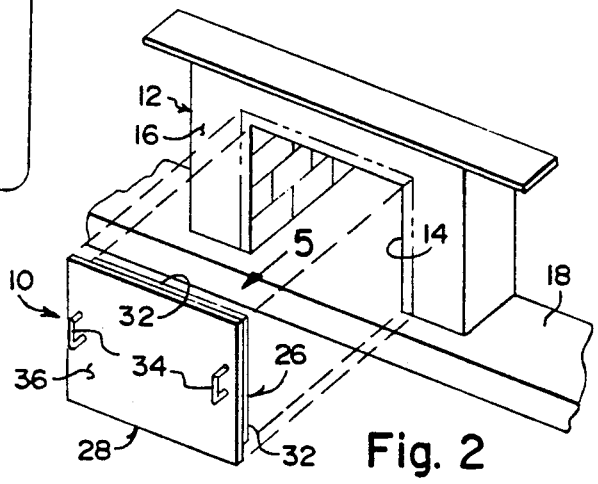
FIG. 2 is a diagrammatic perspective view thereof with the instant invention exploded therefrom.
Figure 5:
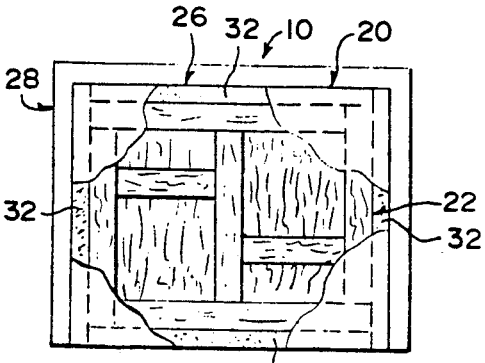
FIG. 5 is a rear elevational view taken in the direction of arrow 5 in FIG. 2, with parts broken away.

The gasket 26, as best seen in FIG. 4, includes four strips 32 of compressible foam material attached about the sides of the internal support frame 22. A pair of spaced apart handles 34 are affixed to a front surface 36 of the front plate 28, to facilitate ease of installation and removal from the fireplace 12.

The rear plate 20, the internal support frame 22 and the front plate 28 are all fabricated out of a durable strong material, typically but not limited to wood, metal or plastic.

In operative use, it is evident that the handles 34 can be gripped by two hands, so that the rear plate 20 and the internal support frame 22, with the gasket 26 can be quickly and easily inserted and removed from between the opening 14 and the hearth 18. When in place, the fireplace draft eliminator 10 will eliminate almost all air drafts from a chimney and heat loss from a room. When sized properly the resilient foam gasket is quite sufficient to hold the draft eliminator 10 in the fireplace 12 without any requirement for other securement mechanism. When the draft eliminator 10 is fabricated out of all fireproof materials it can also be used to choke out a fire in a fireplace when unusual down draft conditions cause smoke and gases to be undesirably forced back into a dwelling. In the fireproof embodiment the cavities within the frame 22 may obviously filled with an appropriate insulation.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fireplace draft eliminator for a fireplace having an opening in a front face above a hearth, comprising:

a) a rear plate being of the same size and shape as the opening, so as to fit into the opening;

b) an internal support frame being slightly smaller in size and shape as said rear plate and attached to a front surface of said rear plate;

c) a resilient gasket mounted on the periphery of said internal support frame, in which said internal support frame and said gasket together are of the same size and shape as said rear plate, so as to also fit into the opening, with said gasket forming a seal about the opening and the hearth; and d) a front plate of generally the same shape as but of greater marginal extent in height and width than the opening, said front plate attached to a front surface of said internal support frame, so that said front plate can cover the opening and rest flat against the front face of the fireplace, to eliminate the draft through the opening when the fireplace is not being used.

2. A fireplace draft eliminator as recited in claim 1, wherein said gasket includes four strips of compressible foam material attached about the sides of said internal support frame.

3. A fireplace draft eliminator as recited in claim 2, further including a pair of spaced apart handles affixed to a front surface of said front plate to facilitate ease of installation and removal from the fireplace.

4. A fireplace draft eliminator as recited in claim 3, wherein said rear plate, said internal support frame and said front plate are all fabricated out of a fireproof strong material.

* * * * *